US009978347B1

(12) United States Patent
Liang

(10) Patent No.: US 9,978,347 B1
(45) Date of Patent: May 22, 2018

(54) INTEGRAL SPRING-HIDDEN CAPO

(71) Applicant: SHENZHEN MUZITECH ELECTRONICS CO., LTD, Shenzhen (CN)

(72) Inventor: Jian Liang, Guangdong (CN)

(73) Assignee: SHENZHEN MUZITECH TECHNOLOGY CO., LTD., Baoan District, Shenzhen (CN)

( * ) Notice: Subject to any disclaimer, the term of this patent is extended or adjusted under 35 U.S.C. 154(b) by 0 days. days.

(21) Appl. No.: 15/659,074

(22) Filed: Jul. 25, 2017

(30) Foreign Application Priority Data

Jun. 21, 2017 (CN) ..... 2017 1 0475765

(51) Int. Cl.
*G10D 3/04* (2006.01)

(52) U.S. Cl.
CPC ..... *G10D 3/043* (2013.01)

(58) Field of Classification Search
CPC ..... G10D 3/043
USPC ..... 84/318
See application file for complete search history.

(56) References Cited

U.S. PATENT DOCUMENTS 468,193 A * 2/1892 Dahlman et al. ..... G10D 3/043 84/318
4,048,894 A * 9/1977 Myerson ..... G10D 3/043 84/318
4,104,947 A * 8/1978 Oster ..... G10D 3/043 84/318
4,143,576 A * 3/1979 Nichols ..... G10D 3/043 84/318
4,149,443 A * 4/1979 Bringe ..... G10D 3/043 84/318
4,250,790 A * 2/1981 Shubb ..... G10D 3/043 84/318
4,324,165 A * 4/1982 Wilkerson ..... G10D 3/043 84/318
4,583,440 A * 4/1986 Powell, Jr. ..... G10D 3/043 84/318
5,081,894 A * 1/1992 Paige ..... G10D 3/043 84/318
5,117,723 A * 6/1992 Veenschoten ..... G10D 3/043 84/318
5,492,045 A * 2/1996 Roblee ..... G10D 3/043 84/318

(Continued)

FOREIGN PATENT DOCUMENTS

GB 2141860 A * 1/1985 ..... G10D 3/043

*Primary Examiner* — David Warren
*Assistant Examiner* — Christina Schreiber
(74) *Attorney, Agent, or Firm* — Muncy, Geissler, Olds & Lowe, P.C.

(57) ABSTRACT

The invention provides an integral spring-hidden capo comprising a U-shaped capo skeleton, wherein a capo skeleton rotating shaft hole is arranged at an end at an opening of the U-shaped capo skeleton, the capo skeleton rotating shaft hole is equipped with an integral push-pull handle component, one end of a power unit is located above the capo skeleton rotating shaft hole of the U-shaped capo skeleton, and the other end of the power unit is hidden inside the integral push-pull handle component. The invention has the following beneficial effects: the capo can be stably and portably operated by two fingers, and has high integrity and a simple process.

9 Claims, 8 Drawing Sheets

(56) References Cited

U.S. PATENT DOCUMENTS 5,623,110 A * 4/1997 Hoglund ..... G10D 3/043 84/318
5,792,969 A * 8/1998 Shubb ..... G10D 3/043 84/318
6,008,441 A * 12/1999 Steinberger ..... G10D 3/043 84/318
6,459,025 B1 * 10/2002 D'Addario ..... G10D 3/043 84/318
6,835,880 B1 * 12/2004 Silva ..... G10D 3/043 84/315
7,511,208 B1 * 3/2009 Kyser ..... G10D 3/043 84/318
7,745,710 B2 * 6/2010 Campling ..... G10D 3/043 84/312 R
7,932,450 B2 * 4/2011 Chen ..... G10D 3/043 84/318
7,939,736 B2 * 5/2011 Campling ..... G10D 3/043 84/315
8,093,476 B2 * 1/2012 Vochezer ..... G10D 3/043 84/318
8,779,262 B1 * 7/2014 Steinberger ..... G10D 3/043 84/318
9,190,033 B2 * 11/2015 Bradley ..... G10D 3/043
9,711,115 B2 * 7/2017 Bradley ..... G10D 3/043
2007/0143929 A1 * 6/2007 Selin ..... B25F 1/00 7/151
2008/0168882 A1 * 7/2008 Campling ..... G10D 3/043 84/318
2009/0064842 A1 * 3/2009 Small ..... G10D 3/043 84/318
2010/0154616 A1 * 6/2010 Campling ..... G10D 3/043 84/318
2011/0023683 A1 * 2/2011 Vochezer ..... G10D 3/043 84/318
2014/0013924 A1 * 1/2014 Campling ..... G10D 3/043 84/318
2015/0107437 A1 * 4/2015 Cannon ..... G10D 3/043 84/318
2015/0128784 A1 * 5/2015 Bradley ..... G10D 3/043 84/318
2016/0247490 A1 * 8/2016 Campling ..... G10D 3/043
2017/0103736 A1 * 4/2017 Kinney ..... G10D 3/043

* cited by examiner

INTEGRAL SPRING-HIDDEN CAPO

FIELD OF THE INVENTION

The invention relates to a capo for a stringed instrument, and particularly to an integral spring-hidden capo for instruments such as a guitar and a banjo.

BACKGROUND OF THE INVENTION

Conventional capos, especially spring-type capos (mostly spring-exposed capos) need to be gripped and operated by the whole palm, and almost all of such capos are provided with a rotating shaft point at an upper end of a capo for clamping a neck of a musical instrument in terms of structural principles. That is to say, a conventional spring-powered capo is basically of the most original staggered clamping-body structure in nature, i.e. an original staggered clamping-body structure such as a spring is arranged at an outer clamping side of a clamp or the other end of an intersecting shaft. An existing capo has the disadvantages of too simple operation experience, exposure of a spring of a power device, low integrity of a product structure or the like. In view of the limitation that a spring is very close to a rotating shaft pivot when a clamping body is nipped, most conventional capos have low efficacy of elasticity due to the inconsistence between the direction of acting force of the spring and the clamping direction of the clamping body, but various conventional capos basically have no obvious difference in substantial operation experience.

SUMMARY OF THE INVENTION

An object of the invention is to provide a novel integral spring-hidden capo so as to overcome the disadvantages of too simple operation experience, exposure of a spring of a power device, low integrity of a product structure, low efficacy of elasticity or the like in an existing capo.

The invention is realized by the following technical solution: an integral spring-hidden capo is configured to tightly press a neck by inverting a rotating shaft and comprises a U-shaped capo skeleton, wherein a capo skeleton rotating shaft hole is arranged at an end at an opening of the U-shaped capo skeleton, the capo skeleton rotating shaft hole is equipped with an integral push-pull handle component, one end of a power unit is located above the capo skeleton rotating shaft hole of the U-shaped capo skeleton, the other end of the power unit is hidden inside the integral push-pull handle component, and an upper part of the integral push-pull handle component is provided with a finger force-bearing component for allowing the integral push-pull handle component to move upwards along an arc trajectory around the capo skeleton rotating shaft hole.

Further, the U-shaped capo skeleton comprises a string-pressing arm, a connecting arm, a pressing force-bearing arm and a power arm, an upper end of the string-pressing arm is bent upwards to form the extending connecting arm, the connecting arm is bend downwards to form a short segment of the pressing force-bearing arm, the pressing force-bearing arm extends downwards to form the power arm, a mounting groove for a power unit fixing seat is arranged on an outer side wall of one side of the power arm facing the string-pressing arm, and the capo skeleton rotating shaft hole is arranged at an end of the power arm.

Further, the integral push-pull handle component is of a sector structure, a rotating shaft hole is arranged at a lower part of the integral push-pull handle component, the rotating shaft hole and the capo skeleton rotating shaft hole match each other and are connected by a rotating shaft rivet, and the integral push-pull handle component is provided with a rivet cover plate at the rotating shaft rivet; and a power arm groove for being embedded by the power arm is arranged at one side of the integral push-pull handle component near the power arm, and an outer side wall of the integral push-pull handle component is an arc-shaped neck-back pressure wall.

Further, the power unit comprises a spring fixing seat, a spring and a spring fixing groove, the spring fixing groove is located inside the integral push-pull handle component, the spring fixing seat is embedded into the mounting groove for the power unit fixing seat, one end of the spring is embedded onto the spring fixing seat, and the other end of the spring is embedded into the spring fixing groove.

Further, a stop piece is arranged at a front end of the string-pressing arm and a string-pressing elastic rubber pad is arranged on an inner side wall of the string-pressing arm.

Further, an outer side wall of the pressing force-bearing arm is designed as a cambered surface conforming to a thumb, and an antislip strip is arranged on the outer side wall of the pressing force-bearing arm.

Further, the end of the power arm extends upwards to form a rotation angle limiting piece of a rotating shaft.

Further, the finger force-bearing component at the upper part of the integral push-pull handle component is a finger-passable round hole.

Further, a rotating wheel mechanism mounting station is arranged between the neck-back pressure wall and a neck-back contact surface, and the rotating wheel mechanism mounting station is internally provided with a rotating wheel mechanism; and the rotating wheel mechanism comprises a rotating wheel shaft and a rotating wheel, the rotating wheel is sleeved on the rotating wheel shaft and capable of rotating about the rotating wheel shaft, an upper part of the rotating wheel is embedded into the rotating wheel mechanism mounting station, the rotating wheel shaft is mounted on a mounting seat at both sides of the rotating wheel mechanism mounting station, the rotating wheel functions to press against a neck back during operation of the capo, an outer ring of the rotating wheel is sleeved with a soft rubber kit, and the soft rubber kit is used for protecting a neck when the rotating wheel contacts the neck.

Further, the U-shaped capo skeleton is made of a metallic material.

Further, the capo can also be integrated with a tuner functional module.

The integral push-pull handle component is mounted at an inner side of the U-shaped capo skeleton by the rotating shaft rivet, and the power unit is built in the integral push-pull handle component. During operation of the capo, a finger passes through the round hole at the upper part of the integral push-pull handle component, a thumb presses the pressing force-bearing arm, the integral push-pull handle component moves upwards along an arc trajectory around the capo skeleton rotating shaft hole, the capo is sleeved on a neck, and then force is released from a hand.

The integral push-pull handle component rotates under the action of the power unit, then the integral push-pull handle component and a neck back-pressing elastic rubber sheet adhered on the integral push-pull handle component are converged towards and squeeze the string-pressing arm of the U-shaped capo skeleton, the neck back-pressing elastic rubber sheet props against a neck back, and the string-pressing elastic rubber pad presses strings. Under such action, both sides of the neck are subjected to a locking effect due to inward squeezing from buffer rubber at the two sides, thus achieving the effect of tightly pressing the strings.

The beneficial effects of the invention are as follows:

(1) the capo can be more skillfully and portably operated, can be stably operated by two fingers and can work with higher efficiency;

(2) the capo can overcome the disadvantages of low efficacy and utilization rate of spring elasticity as well as non-portable and unstable operation in an existing capo, and can greatly improve the string-clamping stability and avoid easy slippage of a conventional capo from a hand due to highly efficient inversion of a rotating shaft and the structure of a power component of a rotator for clamping;

(3) the capo has high integrity, aesthetic and elegant appearance, and a simple production process; and (4) during operation of the capo, actually due to a freely-rotatable rotating wheel which is mounted at one side of the capo for clamping and conforming to a neck, the capo can exhibit more excellent self-angle-adjustment capability under the action of spring elasticity when the neck is clamped, i.e. the capo can exhibit more excellent self-adaptive capability and can stably clamp the strings on the neck in a more balanced manner under the rotating action of the rotating wheel, thus all the strings distributed at upper and lower ends, the center and other parts of the neck can be clamped by the capo in a balanced and conformable manner.

REFERENCE NUMERALS

1. U-shaped capo skeleton; 11. string-pressing arm; 110. stop piece; 111. string-pressing elastic rubber pad; 12. connecting arm; 13. pressing force-bearing arm; 130. antislip strip; 14. power arm; 141. rotation angle limiting piece of rotating shaft; 142. mounting groove for power unit fixing seat; 2. capo skeleton rotating shaft hole; 3. integral push-pull handle component; 31. rotating shaft hole; 32. rotating shaft rivet; 33. rivet cover plate; 34. neck-back pressure wall; 35. power arm groove; 4. power unit; 41. spring fixing seat; 42. spring; 43. spring fixing groove; 5. finger force-bearing component; 51. finger-passable round hole; 6. rotating wheel mechanism mounting station; 61. rotating wheel mechanism; 610. rotating wheel shaft; 611. rotating wheel; 612. soft rubber kit; 62. mounting seat.

DETAILED DESCRIPTION OF THE INVENTION

The invention will be further described with reference to the drawings and particular embodiments.

Embodiment 1

Figure 1:
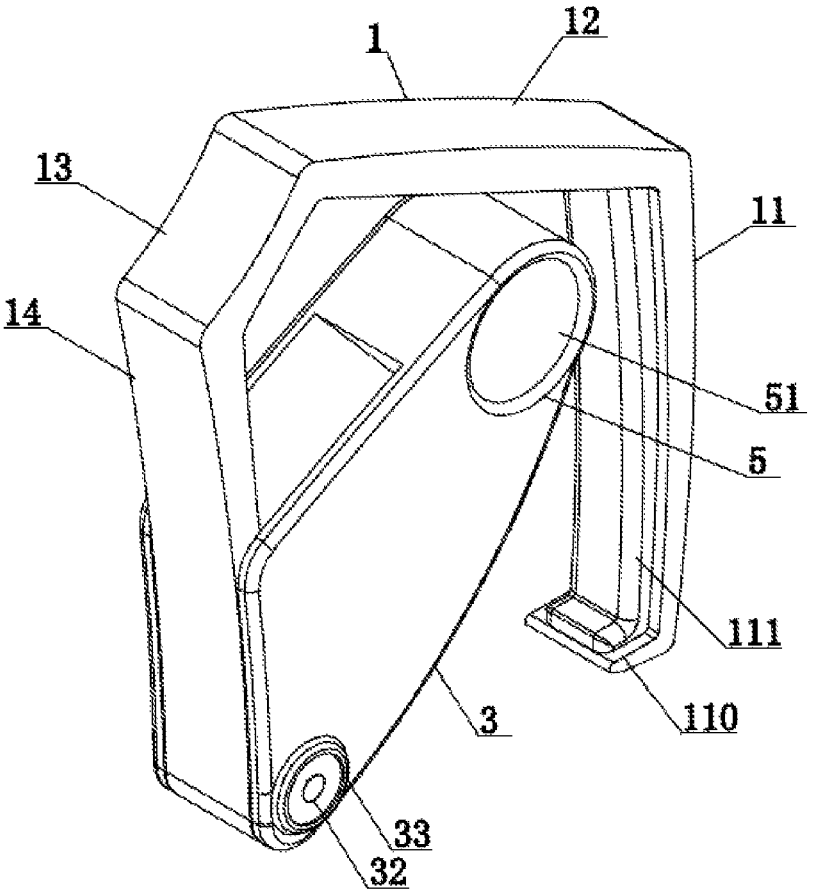
FIG. 1 is a schematic structural view of an integral spring-hidden capo of the invention.
Figure 2:
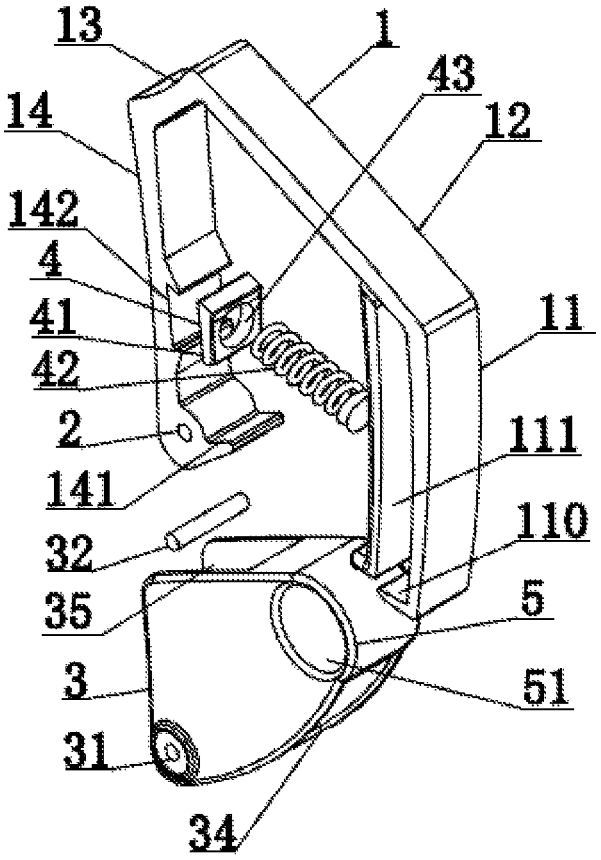
FIG. 2 is an exploded schematic structural view of the integral spring-hidden capo of the invention.
Figure 3:
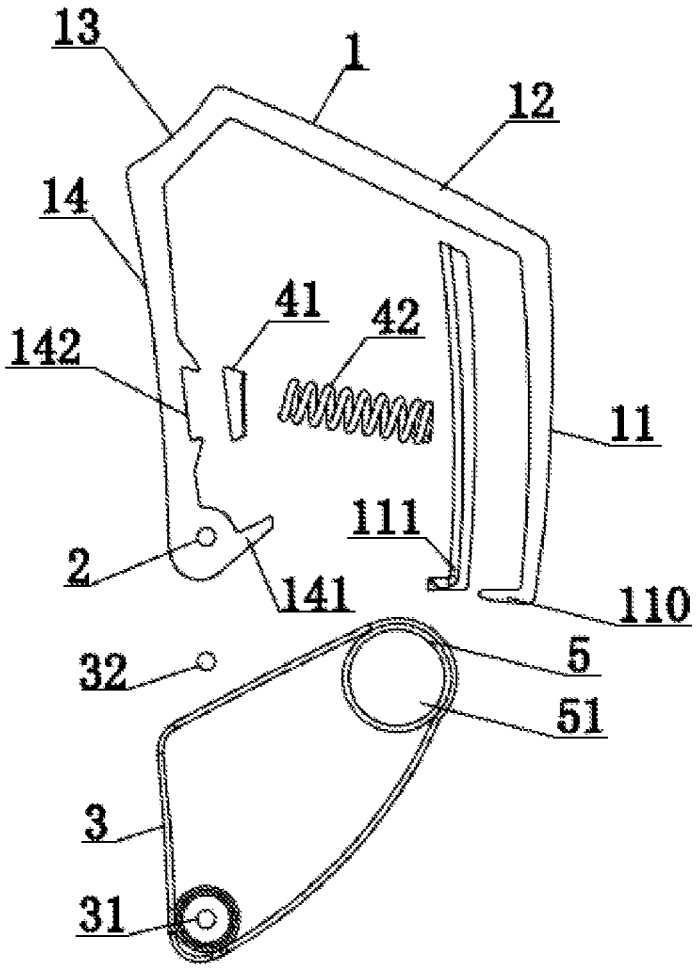
FIG. 3 is an exploded schematic structural side view of the integral spring-hidden capo of the invention.
Figure 4:
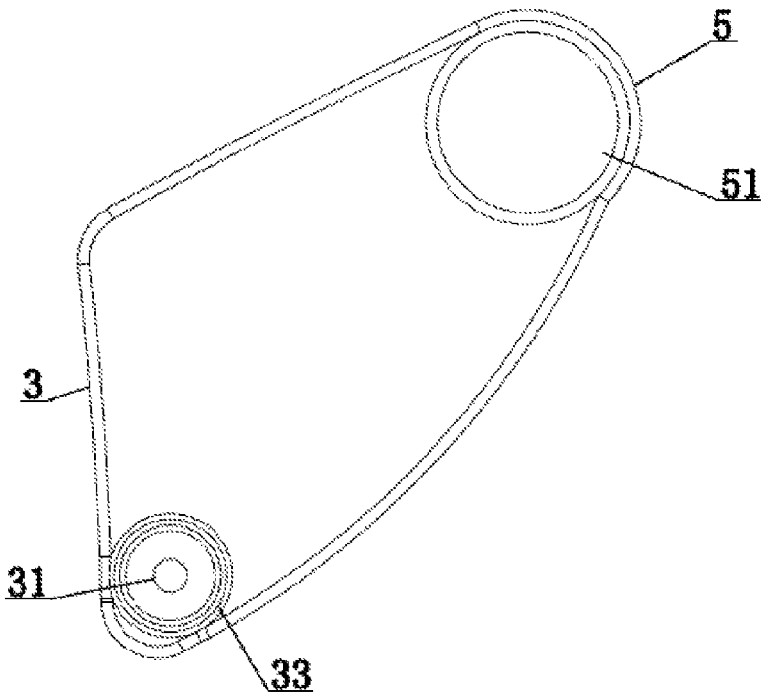
FIG. 4 is a schematic structural view of an integral push-pull handle component and a finger force-bearing component of the invention.
Figure 5:
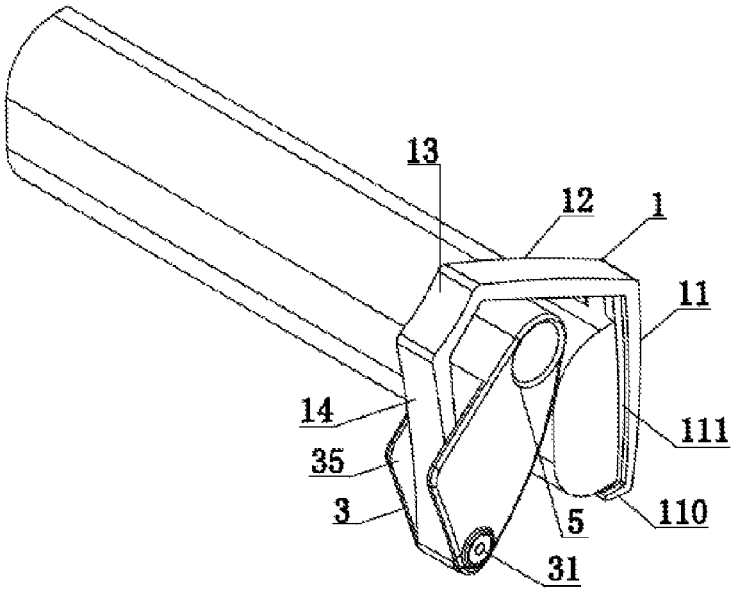
FIG. 5 is a schematic structural working view of the integral spring-hidden capo of the invention.

As shown in FIGS. 1, 2, 3, 4 and 5, an integral spring-hidden capo is configured to tightly press a neck by inverting a rotating shaft and comprises a U-shaped capo skeleton 1, wherein a capo skeleton rotating shaft hole 2 is arranged at an end at an opening of the U-shaped capo skeleton 1, the capo skeleton rotating shaft hole 2 is equipped with an integral push-pull handle component 3, one end of a power unit 4 is located above the capo skeleton rotating shaft hole 2 of the U-shaped capo skeleton 1, the other end of the power unit 4 is hidden inside the integral push-pull handle component 3, and an upper part of the integral push-pull handle component 3 is provided with a finger force-bearing component 5 for allowing the integral push-pull handle component 3 to move upwards along an arc trajectory around the capo skeleton rotating shaft hole 2.

Preferably, the U-shaped capo skeleton 1 comprises a string-pressing arm 11, a connecting arm 12, a pressing force-bearing arm 13 and a power arm 14, an upper end of the string-pressing arm 11 is bent upwards to form the extending connecting arm 12, the connecting arm 12 is bend downwards to form a short segment of the pressing force-bearing arm 13, the pressing force-bearing arm 13 extends downwards to form the power arm 14, a mounting groove 142 for a power unit fixing seat is arranged on an outer side wall of one side of the power arm 14 facing the string-pressing arm 11, and the capo skeleton rotating shaft hole 2 is arranged at an end of the power arm 14.

Preferably, the integral push-pull handle component 3 is of a sector structure, a rotating shaft hole 31 is arranged at a lower part of the integral push-pull handle component 3, the rotating shaft hole 31 and the capo skeleton rotating shaft hole 2 match each other and are connected by a rotating shaft rivet 32, and the integral push-pull handle component 3 is provided with a rivet cover plate 33 at the rotating shaft rivet 32; and a power arm groove 35 for being embedded by the power arm is arranged at one side of the integral push-pull handle component 3 near the power arm 14, and an outer side wall of the integral push-pull handle component 3 is an arc-shaped neck-back pressure wall 34.

Preferably, the power unit 4 comprises a spring fixing seat 41, a spring 42 and a spring fixing groove 43, the spring fixing groove 43 is located inside the integral push-pull handle component 3, the spring fixing seat 41 is embedded into the mounting groove 142 for the power unit fixing seat, one end of the spring 42 is embedded onto the spring fixing seat 41, and the other end of the spring 42 is embedded into the spring fixing groove 43.

Preferably, a stop piece 110 is arranged at a front end of the string-pressing arm 11 and a string-pressing elastic rubber pad 111 is arranged on an inner side wall of the string-pressing arm 11.

Preferably, an outer side wall of the pressing force-bearing arm 13 is designed as a cambered surface conforming to a thumb, and an antislip strip 130 is arranged on the outer side wall of the pressing force-bearing arm 13.

Preferably, the end of the power arm extends upwards to form a rotation angle limiting piece of a rotating shaft.

Preferably, the finger force-bearing component 5 at the upper part of the integral push-pull handle component 3 is a finger-passable round hole 51.

Preferably, the U-shaped capo skeleton 1 is made of a metallic material.

Preferably, the capo can also be integrated with a tuner functional module.

Embodiment 2

Figure 6:
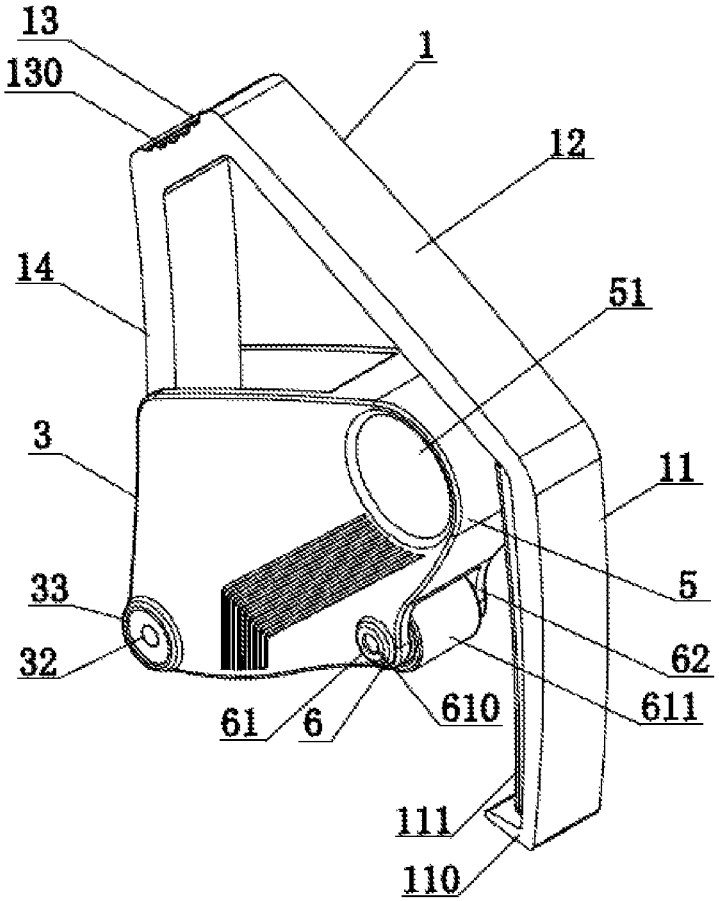
FIG. 6 is a schematic structural view of Embodiment 2 of the integral spring-hidden capo of the invention.
Figure 7:
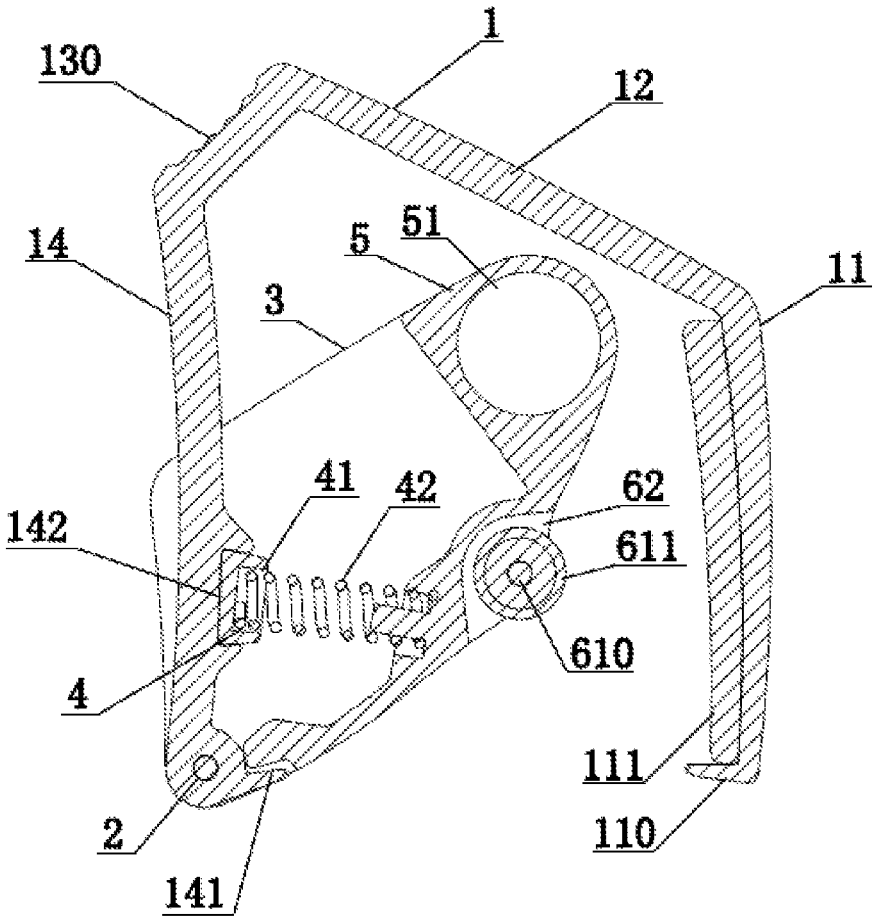
FIG. 7 is a schematic sectional structural view of Embodiment 2 of the integral spring-hidden capo of the invention.
Figure 8:
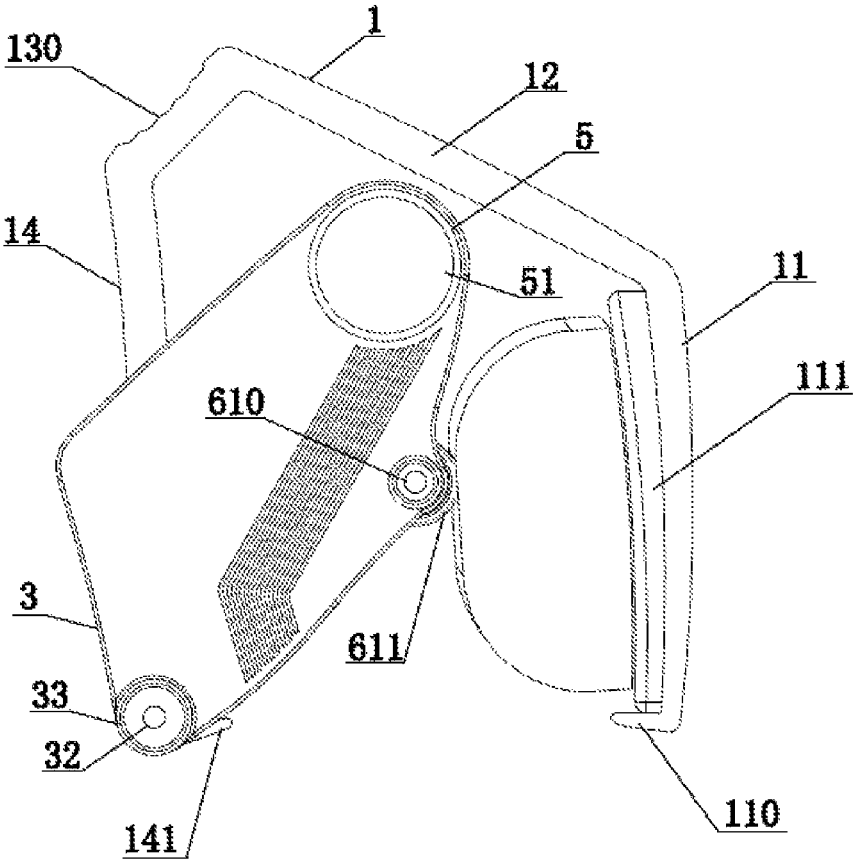
FIG. 8 is a schematic view showing the working effects of Embodiment 2 of the integral spring-hidden capo of the invention.
Figure 9:
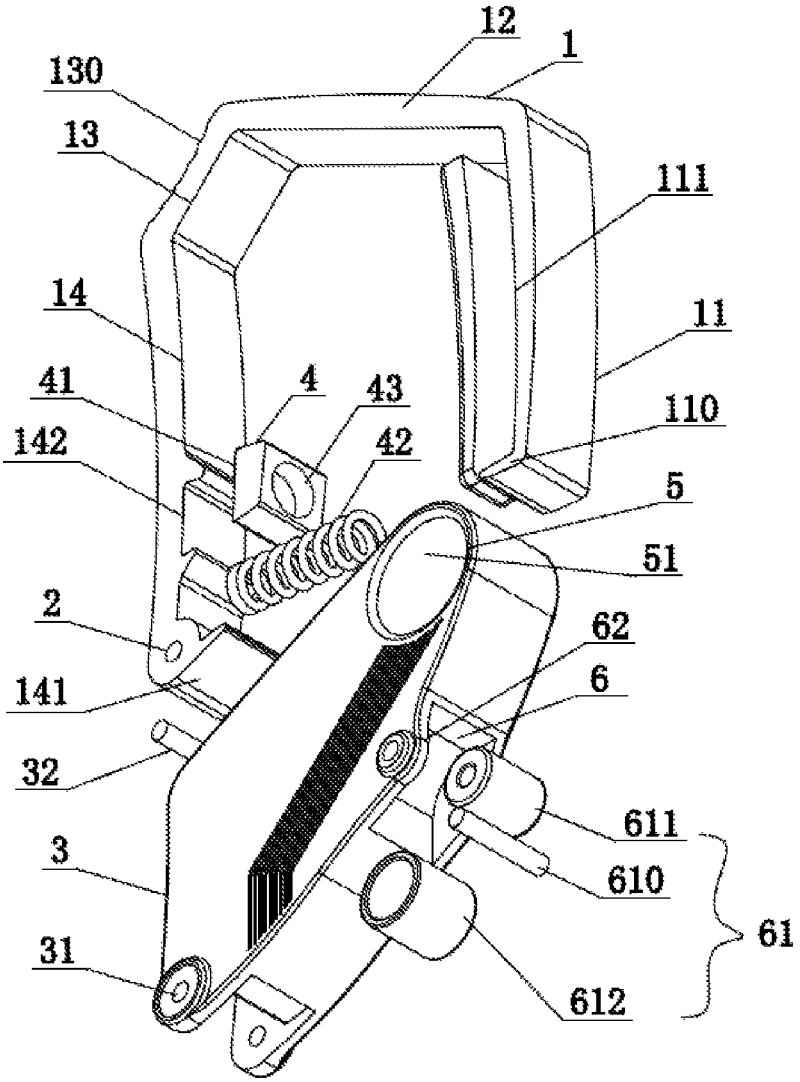
FIG. 9 is an exploded view of Embodiment 2 of the integral spring-hidden capo of the invention.

As shown in FIGS. 6, 7, 8 and 9, a rotating wheel mechanism mounting station 6 is arranged between the neck-back pressure wall 34 and a neck-back contact surface, and the rotating wheel mechanism mounting station 6 is internally provided with a rotating wheel mechanism 61; and the rotating wheel mechanism 61 comprises a rotating wheel shaft 610 and a rotating wheel 611, the rotating wheel 611 is sleeved on the rotating wheel shaft 610 and capable of rotating about the rotating wheel shaft 610, an upper part of the rotating wheel 611 is embedded into the rotating wheel mechanism mounting station 6, the rotating wheel shaft 610 is mounted on a mounting seat 62 at both sides of the rotating wheel mechanism mounting station 6, the rotating wheel 611 functions to press against a neck back during operation of the capo, an outer ring of the rotating wheel 611 is sleeved with a soft rubber kit 612, and the soft rubber kit 612 is used for protecting a neck when the rotating wheel 611 contacts the neck.

Those skilled in the art of the invention can also make appropriate alterations and modifications to the above embodiments according to the disclosures and teachings of the above description. The invention is therefore not limited to the particular embodiments disclosed and described above. Some modifications and alterations to the invention also should fall into the protection scope of the claims of the invention. In addition, some specific terms are used in the present description, but these terms are only for the convenience of illustration and do not limit the invention in any way.

The invention claimed is:

1. An integral spring-hidden capo comprising a U-shaped capo skeleton, a capo skeleton rotating shaft hole being arranged at an end at an opening of the U-shaped capo skeleton, the capo skeleton rotating shaft hole being equipped with an integral push-pull handle component, one end of a power unit being located above the capo skeleton rotating shaft hole of the U-shaped capo skeleton, the other end of the power unit being hidden inside the integral push-pull handle component, and an upper part of the integral push-pull handle component being provided with a finger force-bearing component for allowing the integral push-pull handle component to move upwards along an arc trajectory around the capo skeleton rotating shaft hole;

wherein the U-shaped capo skeleton comprises a string-pressing arm, a connecting arm, a pressing force-bearing arm and a power arm, an upper end of the string-pressing arm is bent upwards to form the extending connecting arm, the connecting arm is bend downwards to form a short segment of the pressing force-bearing arm, the pressing force-bearing arm extends downwards to form the power aunt, a mounting groove for a power unit fixing seat is arranged on an outer side wall of one side of the power arm facing the string-pressing arm, and the capo skeleton rotating shaft hole is arranged at an end of the power arm.

2. The integral spring-hidden capo according to claim 1, wherein the power unit comprises a spring fixing seat, a spring and a spring fixing groove, the spring fixing groove is located inside the integral push-pull handle component, the spring fixing seat is embedded into the mounting groove for the power unit fixing seat, one end of the spring is embedded onto the spring fixing seat, and the other end of the spring is embedded into the spring fixing groove.

3. The integral spring-hidden capo according to claim 1, wherein a stop piece is arranged at a front end of the string-pressing arm and a string-pressing elastic rubber pad is arranged on an inner side wall of the string-pressing arm.

4. The integral spring-hidden capo according to claim 1, wherein an outer side wall of the pressing force-bearing arm is designed as a cambered surface conforming to a thumb, and an antislip strip is arranged on the outer side wall of the pressing force-bearing arm.

5. The integral spring-hidden capo according to claim 1, wherein the end of the power arm extends upwards to form a rotation angle limiting piece of a rotating shaft.

6. The integral spring-hidden capo according to claim 1, wherein the finger force-bearing component at the upper part of the integral push-pull handle component is a finger-passable round hole.

7. The integral spring-hidden capo according to claim 1, wherein the U-shaped capo skeleton is made of a metallic material.

8. An integral spring-hidden capo comprising a U-shaped capo skeleton, a capo skeleton rotating shaft hole being arranged at an end at an opening of the U-shaped capo skeleton, the capo skeleton rotating shaft hole being equipped with an integral push-pull handle component, one end of a power unit being located above the capo skeleton rotating shaft hole of the U-shaped capo skeleton, the other end of the power unit being hidden inside the integral push-pull handle component, and an upper part of the integral push-pull handle component being provided with a finger force-bearing component for allowing the integral push-pull handle component to move upwards along an arc trajectory around the capo skeleton rotating shaft hole;

wherein the integral push-pull handle component is of a sector structure, a rotating shaft hole is arranged at a lower part of the integral push-pull handle component, the rotating shaft hole and the capo skeleton rotating shaft hole match each other and are connected by a rotating shaft rivet, and the integral push-pull handle component is provided with a rivet cover plate at the rotating shaft rivet; and a power arm groove for being embedded by a power arm is arranged at one side of the integral push-pull handle component near the power arm, and an outer side wall of the integral push-pull handle component is an arc-shaped neck-back pressure wall.

9. The integral spring-hidden capo according to claim 8, wherein a rotating wheel mechanism mounting station is arranged between the neck-back pressure wall and a neck-back contact surface, and the rotating wheel mechanism mounting station is internally provided with a rotating wheel mechanism; and the rotating wheel mechanism comprises a rotating wheel shaft and a rotating wheel, the rotating wheel is sleeved on the rotating wheel shaft and configured to rotate about the rotating wheel shaft, an upper part of the rotating wheel is embedded into the rotating wheel mechanism mounting station, the rotating wheel shaft is mounted on a mounting seat at both sides of the rotating wheel mechanism mounting station, the rotating wheel functions to press against a neck back during operation of the capo, an outer ring of the rotating wheel is sleeved with a soft rubber kit, and the soft rubber kit is used for protecting a neck when the rotating wheel contacts the neck.

* * * * *